US006979379B2

(12) United States Patent
White, II

(10) Patent No.: US 6,979,379 B2
(45) Date of Patent: Dec. 27, 2005

(54) METHOD FOR PRESERVING A PERISHABLE PRODUCT

(76) Inventor: Locke White, II, 501 8th St., Radford, VA (US) 24141

( * ) Notice: Subject to any disclaimer, the term of this patent is extended or adjusted under 35 U.S.C. 154(b) by 150 days.

(21) Appl. No.: 10/289,004

(22) Filed: Nov. 6, 2002

(65) Prior Publication Data

US 2004/0003884 A1 Jan. 8, 2004

Related U.S. Application Data

(60) Provisional application No. 60/394,422, filed on Jul. 8, 2002.

(51) Int. Cl.[7] ..... C09J 5/00

(52) U.S. Cl. ..... 156/152; 156/324.4; 156/325; 156/247; 383/211; 383/210; 524/489

(58) Field of Search ..... 156/324.4, 325, 156/247; 524/489; 383/211, 210

(56) References Cited

U.S. PATENT DOCUMENTS

| | | | | |
|---|---|---|---|---|
| 807,887 | A | 12/1905 | Walker | |
| 2,964,812 | A | 12/1960 | Cook | |
| 3,203,621 | A | 8/1965 | Wright | |
| 3,267,052 | A | 8/1966 | Brennan | |
| 3,539,481 | A * | 11/1970 | Parker | 524/271 |
| 3,576,776 | A * | 4/1971 | Muszik et al. | 524/238 |
| 4,644,026 | A | 2/1987 | Shuman et al. | |
| 4,657,960 | A | 4/1987 | Shuman et al. | |
| 4,684,685 | A | 8/1987 | Shuman et al. | |
| 4,755,550 | A | 7/1988 | Shuman et al. | |
| 4,785,940 | A | 11/1988 | Wilson | |
| 4,911,563 | A * | 3/1990 | Ciani | 383/89 |
| 5,018,660 | A * | 5/1991 | Esper et al. | 229/125.42 |
| 5,172,854 | A | 12/1992 | Epstein et al. | |
| 5,188,688 | A | 2/1993 | Boardman et al. | |
| 5,330,099 | A * | 7/1994 | Beales et al. | 229/207 |
| 5,331,023 | A | 7/1994 | Columbus et al. | |
| 5,605,572 | A | 2/1997 | Berger | |
| 5,827,553 | A | 10/1998 | Dimitroglou et al. | |
| 5,853,836 | A | 12/1998 | Zoss | |
| 5,947,304 | A | 9/1999 | Thorp | |
| 6,076,969 | A | 6/2000 | Jaisle et al. | |
| 6,136,119 | A | 10/2000 | Columbus et al. | |
| 6,139,123 | A | 10/2000 | Saenz | |
| 6,284,075 | B1 | 9/2001 | Kaplan | |
| 6,299,966 | B1 * | 10/2001 | Bonke et al. | 428/173 |
| 6,398,412 | B2 | 6/2002 | Wedi et al. | |
| 6,541,098 | B2 * | 4/2003 | Venkatasanthanam et al. | 428/161 |
| 6,613,378 | B1 * | 9/2003 | Erhan et al. | 426/658 |
| 2002/0098348 | A1 * | 7/2002 | McReynolds et al. | 428/343 |

* cited by examiner

*Primary Examiner*—Blaine Copenheaver
*Assistant Examiner*—Chris Schatz
(74) *Attorney, Agent, or Firm*—Schwartz Law Firm P.C.

(57) ABSTRACT

A method is provided for preserving a perishable product contained in a sealed package. The package is adapted for being opened by a consumer to access the product and subsequently re-closed by the consumer for further storage of unused product remaining in the package. The method includes the step of, using a handheld applicator, applying a releasable contact adhesive to an area of the package adjacent to an opening therein formed by the consumer. The package is then folded at the opening such that a portion of the package contacts the adhesive to temporarily re-close the opening, thereby preserving the unused product inside the package.

8 Claims, 7 Drawing Sheets

METHOD FOR PRESERVING A PERISHABLE PRODUCT

TECHNICAL FIELD AND BACKGROUND OF INVENTION

This application relates to a method for preserving a perishable product. The invention is especially applicable to packaged food products which are purchased by a consumer, opened for use, and then re-closed to store remaining food product in the package for later use. In a second application, the invention is a method for preserving leftover food which is stored in an open-top container. In each case, the invention offers a convenient and reliable way to store food and guard against premature spoiling and/or inadvertent spillage.

A recent study by the University of Arizona estimates that U.S. households throw away $30 billion worth of spoiled food annually. This figure is especially staggering considering the fact that billions more are spent each year on consumer food wrap products and food packaging material designed to keep that same food from going bad. Unfortunately, the facts show that these products alone are just not getting the job done.

SUMMARY OF INVENTION

Therefore, it is an object of the invention to provide a method for preserving food products which is both convenient and highly reliable.

It is another object of the invention to provide a method for preserving food products which requires little effort and expense.

It is another object of the invention to provide a method for preserving food products which utilizes a conventional glue stick or other handheld adhesive applicator.

It is another object of the invention to provide a method for preserving food products which utilizes a non-permanent or repositionable adhesive capable of adhering and readhering to any food package or container.

It is another object of the invention to provide a method for preserving food products which utilizes a pressure-sensitive, contact adhesive capable of adhering and readhering to slick surfaces, such as plastic kitchen containers, Teflon-coated pots and pans, kitchen food wraps, and plastic sandwich bags.

It is another object of the invention to provide a method for preserving food products which utilizes a highly aggressive adhesive which performs well in both hot and cold environments, such as inside a refrigerator and oven.

It is another object of the invention to provide a method for preserving food products which utilizes an adhesive which is water-soluble so that it easily washes off surfaces with soap and water in the sink or in the dishwasher.

It is another object of the invention to provide a method for preserving food products which utilizes a common, food-grade adhesive.

It is another object of the invention to provide a method for preserving other packaged items, such as fertilizer, grass seed, or any other product prone to spillage when inadvertently dropped or tipped over.

These and other objects of the present invention are achieved in the preferred embodiments disclosed below by providing a method for preserving a perishable product contained in a sealed package. The package is adapted for being opened by a consumer to access the product and subsequently re-closed by the consumer for further storage of unused product remaining in the package. The method includes the step of, using a handheld applicator, applying a releasable contact adhesive to a first area of the package adjacent to an opening formed in the package by the consumer. A second area of the package is then pressed against the adhesive to temporarily re-close the opening, thereby preserving the unused product inside the package.

The term "perishable product" is used broadly herein to include any product which may spoil, decay, or become stale over a period of time; or which may dissolve or otherwise react when exposed to elements outside of its packaging, such as water, cold, or heat; or which may spill out of its packaging when inadvertently dropped or tipped over.

According to another preferred embodiment of the invention, the method further includes the steps of reopening the package at the opening to access the unused product, and subsequently folding and readhering the package to re-close the opening without further application of the adhesive to the package.

According to another preferred embodiment of the invention, the step of applying the adhesive includes applying the adhesive in a continuous path extending along an entire length of the opening.

According to another preferred embodiment of the invention, the handheld applicator is an elongated stick container.

According to another preferred embodiment of the invention, and notwithstanding the performance of the adhesive, the method further includes placing the unused product contained in the re-closed package in a refrigerator at a temperature less than 50 degrees Fahrenheit.

According to another preferred embodiment of the invention, and notwithstanding the performance of the adhesive, the method includes placing the unused product contained in the re-closed package in a freezer at a temperature less than 32 degrees Fahrenheit.

According to another preferred embodiment of the invention, and notwithstanding the performance of the adhesive, the method includes placing the unused product contained in the re-closed package in an oven at a temperature greater than 100 degrees Fahrenheit.

Preferably, the adhesive is a food-grade adhesive. The term "food-grade adhesive" is defined by FDA specifications found in Title 21 of the Code of Federal Regulations, incorporated in its entirety herein by this reference. Specific examples of adhesive substances generally considered safe in and around food are provided in 21 C.F.R. §§175.105 and 175.125. Suitable adhesives could be sugar based, starch based, or silicone based, for example.

In another embodiment, the invention is a method for preserving a perishable product stored in an open container. The method includes the step of, using a handheld applicator, applying a releasable contact adhesive to an outer surface of the container. The open top of the container is then covered with a thermoplastic wrap such that the wrap contacts the adhesive to releasably seal the container, thereby preserving the product stored in the container.

According to another preferred embodiment of the invention, the method further includes the steps of uncovering the thermoplastic wrap at the open top of the container to access the product, and subsequently readhering the thermoplastic wrap to the container to re-close the open top without further application of the adhesive to the container.

According to another preferred embodiment of the invention, the step of applying the adhesive includes applying the adhesive in a continuous path extending along an entire outside margin of the container adjacent the open top.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
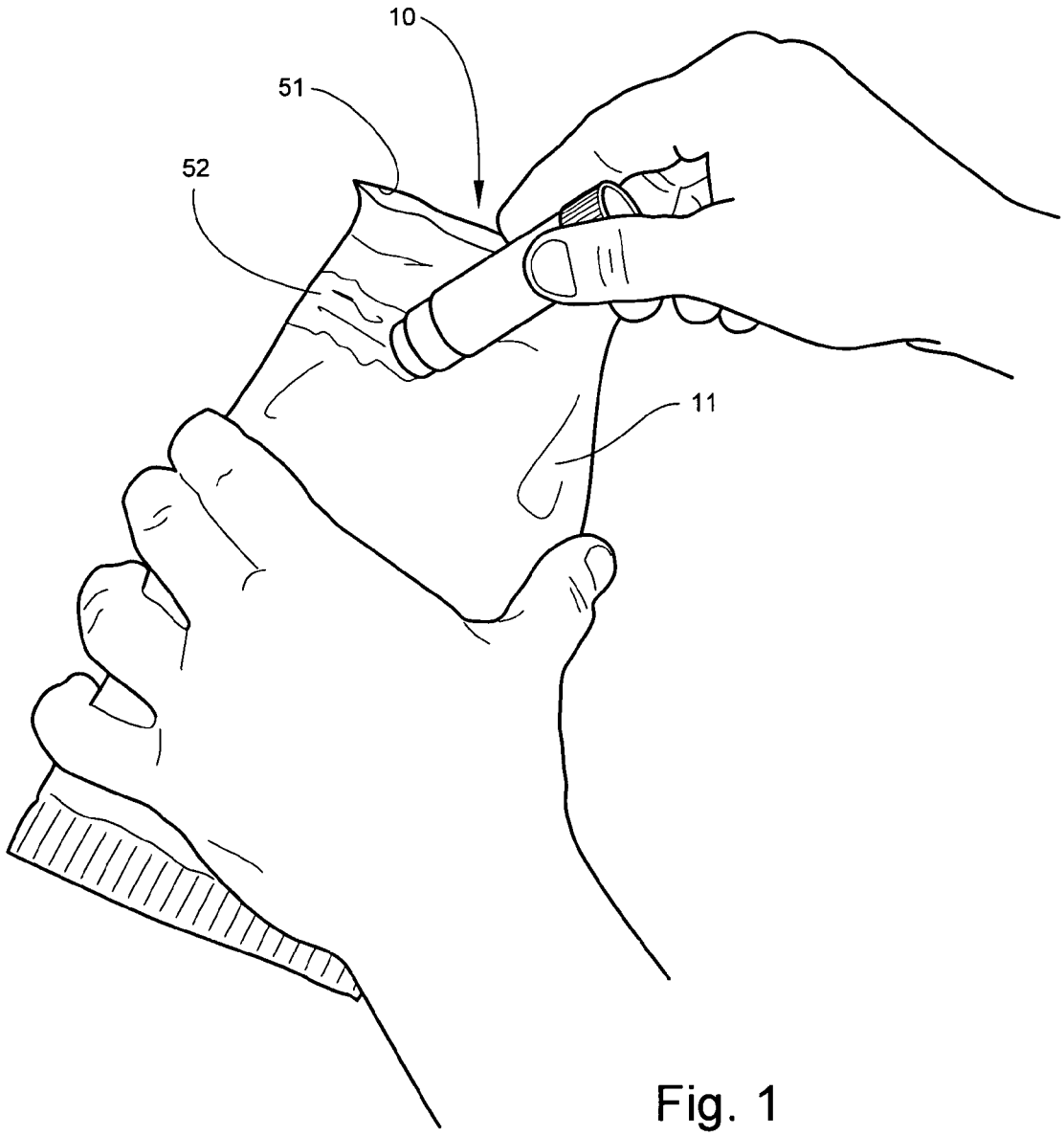
FIG. 1 is a view of an opened food package, and demonstrating application of the contact adhesive used for temporarily closing the package according to one embodiment of the present method.
Figure 2:
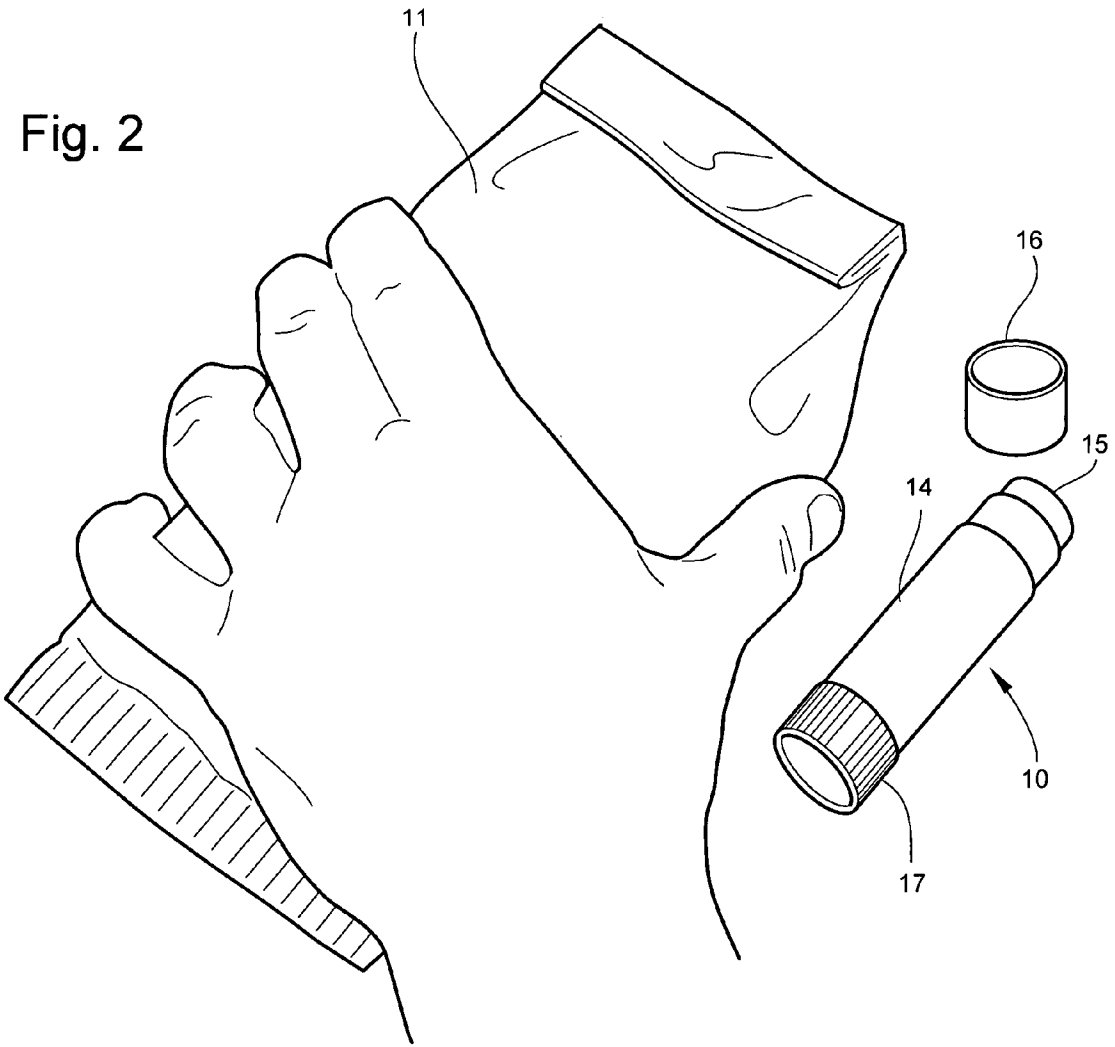
FIG. 2 is a view of the sealed package after application of the present method.

Referring now specifically to the drawings, a handheld glue stick adapted for use in a method according to the present invention is illustrated in FIG. 1, and shown generally at reference numeral 10. In one embodiment, demonstrated in FIGS. 1 and 2, the present method is intended to preserve a perishable food product which is contained in a sealed package 11 when purchased, and which is later opened by a consumer to access the food product and then re-closed for further storage of unused product remaining in the package 11. According to the present method, the remaining food product is preserved inside the package 11 until used again by the consumer. The method is especially applicable to food products, such as potato chips, crackers, box cereal, sugar, flour, bread, and other perishable items commonly purchased at retail grocery stores. In an alternative embodiment, demonstrated in FIGS. 3 and 4, the present method preserves leftover food stored in an open-top container 12. In each case, the method utilizes the glue stick 10, or any other suitable handheld adhesive applicator. The glue stick 10 has an elongated cylindrical shell 14 for containing the adhesive 15, a removable cap 16 covering an open end of the shell 14, and a twisting base 17 to cause extension and retraction of the adhesive 15. Examples of glue sticks applicable for use in the present method include those described in U.S. Pat. Nos. 4,684,685; 5,331,023; 5,409,977; and 6,136,119. The complete disclosure of each of these patents is incorporated herein by reference.

Figures 5, 5A:
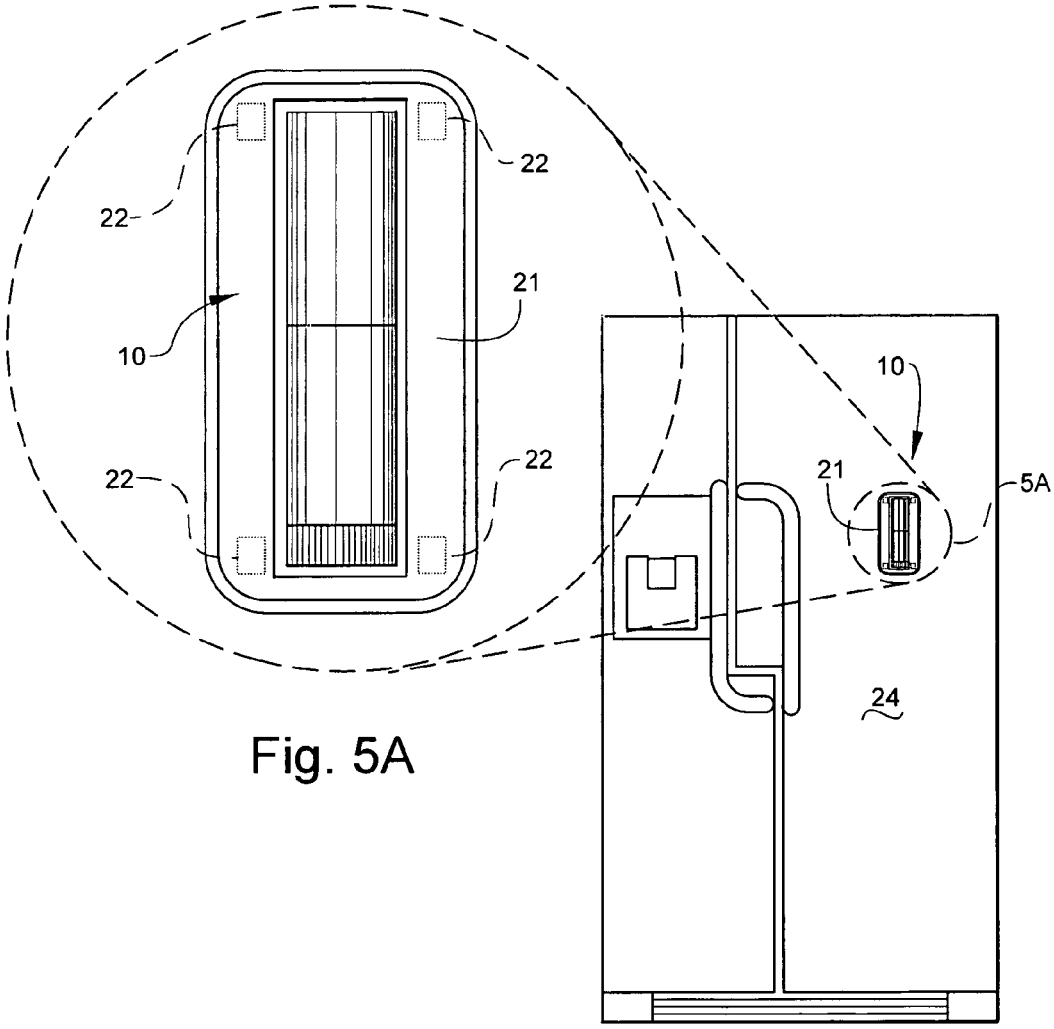
FIG. 5 is a view of the glue stick mounted on the door of a standard refrigerator.
FIG. 5A is an enlarged view of the glue stick and holder shown in the bubble of FIG. 5.
Figure 6:
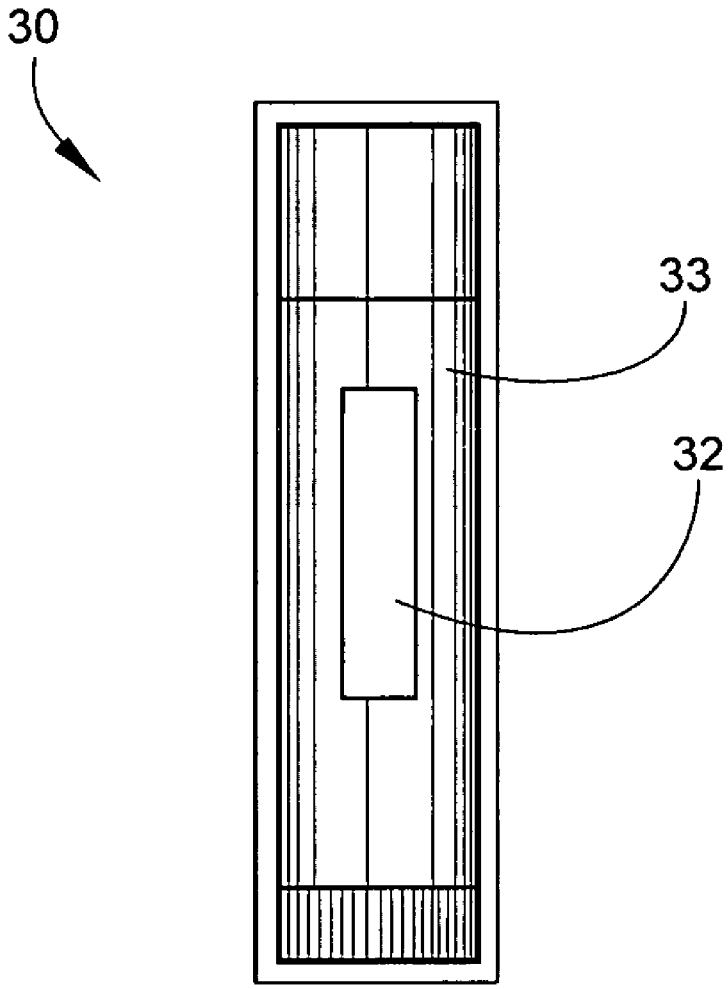
FIG. 6 is an elevational view of a glue stick according to a second preferred embodiment of the invention.
Figure 7:
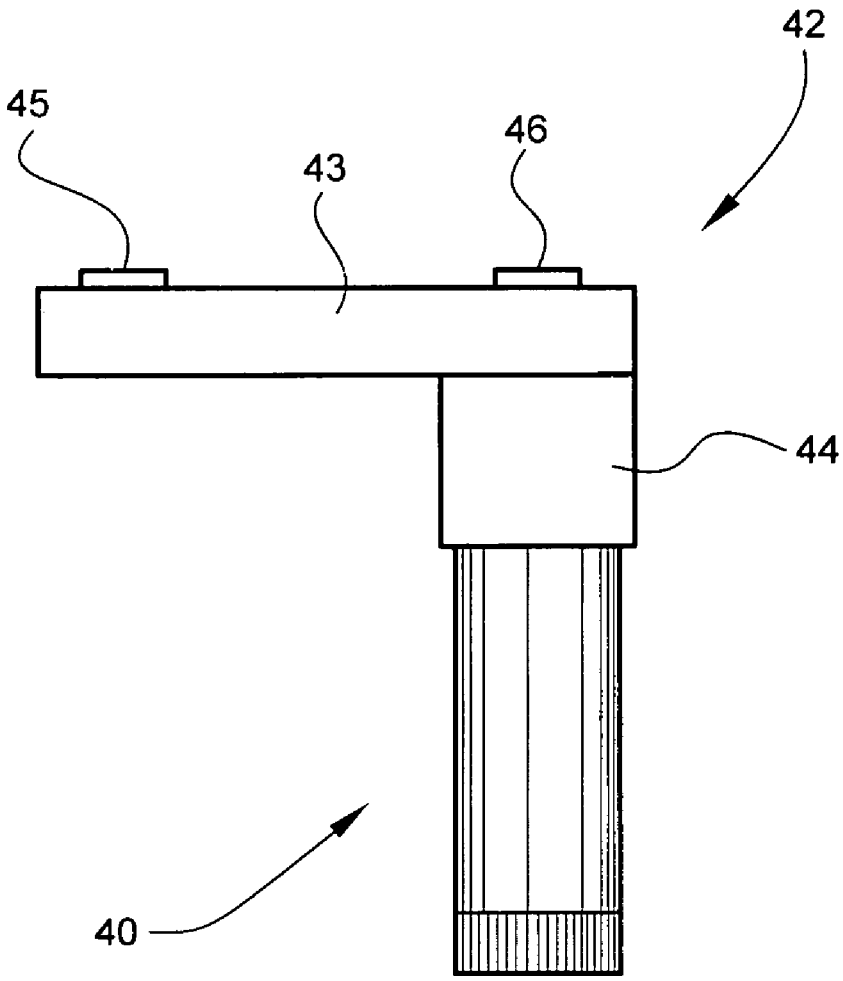
FIG. 7 is an elevational view of a glue stick and holder according to a third preferred embodiment of the invention.

For added convenience, the glue stick 10 is preferably stored in the kitchen area. In the embodiment of FIGS. 5 and 5A, the glue stick 10 is removably mounted in a slightly recessed well formed in a holder 21. The holder 21 has magnets 22 located on its backside and at each corner to magnetically attach the holder 21 to any metal surface, such as a refrigerator door 24. In an alternative embodiment shown in FIG. 6, the glue stick 30 includes a magnet 32 molded with its outer shell 33 to attach the glue stick 30 directly to the metal surface. In yet another embodiment shown in FIG. 7, the glue stick 40 is carried by a holder 42 having an adhesive base 43, and a cylindrical receiver 44 attached to the base 43 and adapted to receive an open end of the glue stick 40. The receiver 44 extends perpendicular to the base 43, and is of a size and shape corresponding to that the of the original cap covering the open end of the glue stick 40. The adhesive base 43 has peel-and-stick pads 45 and 46 which allow the glue stick 40 to be mounted in an inverted position under overhead kitchen cabinets, pantry shelves, and the like.

Referring again to FIGS. 1–4, the present method is applicable for re-closing an opened food package 11 in order to preserve the unused contents of the package 11 for later use. After purchasing the food product, the consumer generally forms an opening 51 in the package 11 by pulling apart the walls of the package 11 at one closed end, or by separating the walls at the closed end along a preformed tear line. The resulting opening 51 typically extends entirely, or at least partially, along the torn end edge of the package 11. In any case, the opening 51 is sufficiently large to conveniently remove the contents of the package 11 for use. To re-close the package 11 according to the present method, the consumer uses the glue stick 10 to apply a thin layer of readhering, pressure-sensitive, contact adhesive 52 to an area of the package 11 adjacent the opening 51. Preferably, the adhesive 52 is applied in a continuous path which extends along the entire length of the opening 51. After applying the adhesive 52, the package 11 is folded at the opening 51 such that a second area of the package 11 is pressed against the adhesive 52 to re-close and seal the package 11. When the consumer desires to use the remaining contents of the package 11, the package 11 is reopened at the previously formed opening 51 by separating the adhering areas of the package 11. Additional unused food product is further preserved by subsequently readhering the first and second areas of the package 11 to re-close the opening 51. The areas are preferably readhered without further application of the adhesive 52 to the package 11.

Figure 3:
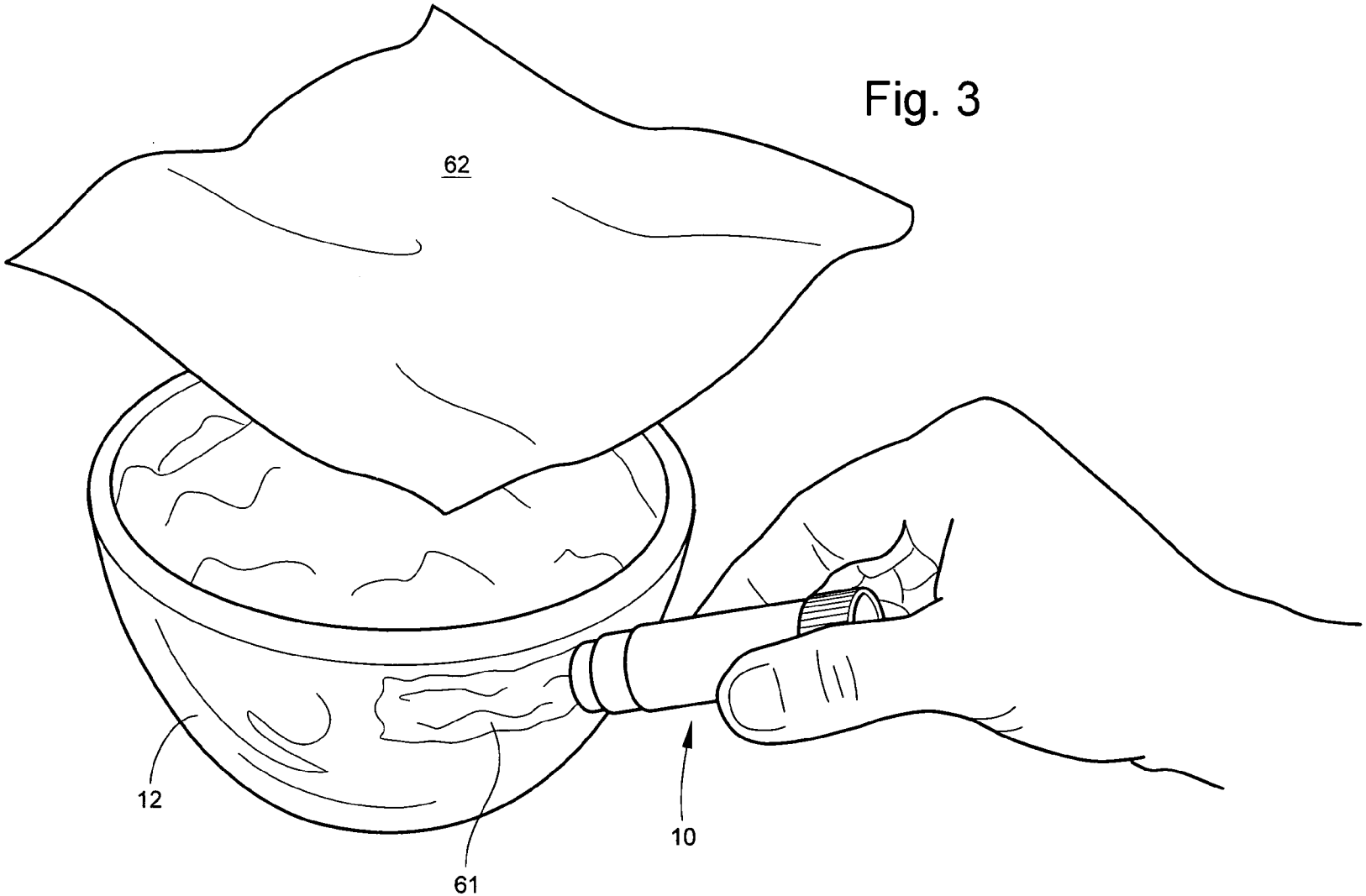
FIG. 3 is a view of an open-top container used for storing leftover food, and demonstrating application of the adhesive and sheet wrap to the container to temporarily close the open top according to a second preferred embodiment of the present method.
Figure 4:
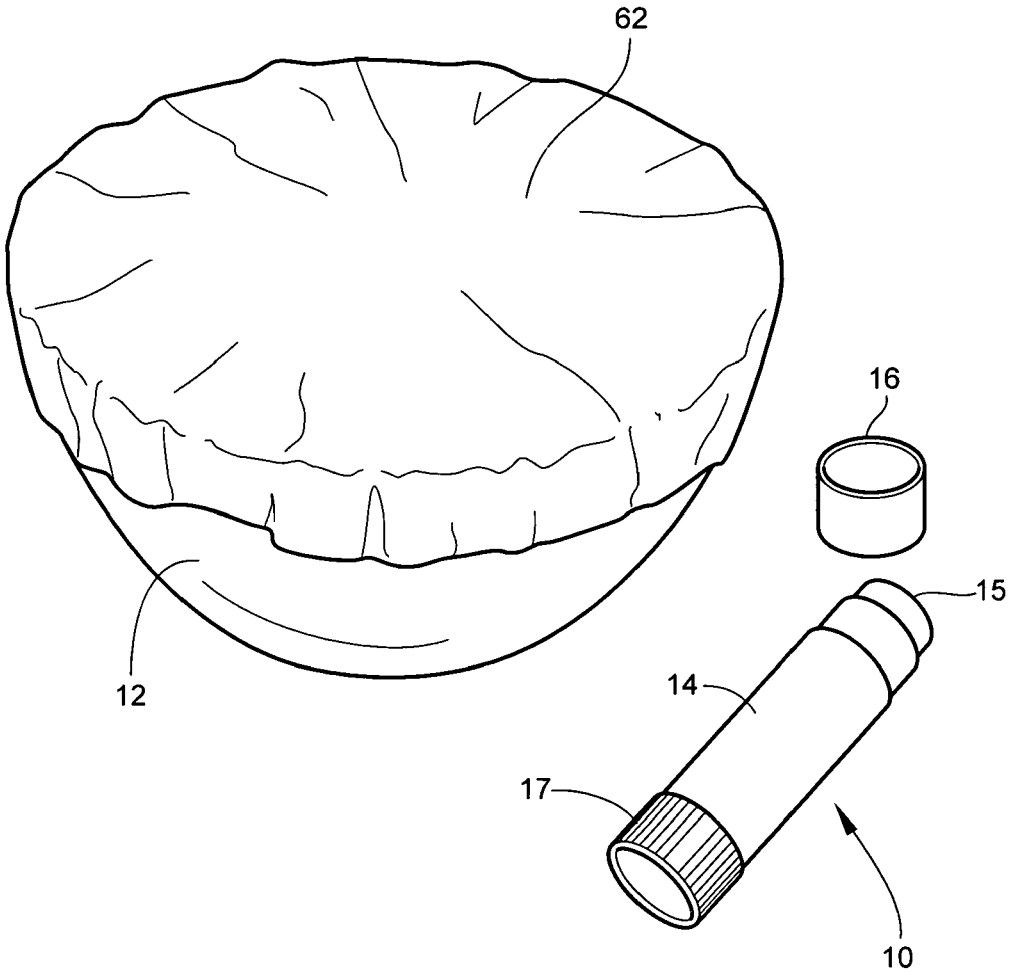
FIG. 4 is a view of the covered container after application of the present method.

A second application of the present method is demonstrated in FIGS. 3 and 4. In this application, leftover food is placed in the open-top container 12 for storage. The glue stick 10 is then used to apply a thin layer of pressure-sensitive, contact adhesive 61 to an outside surface of the container 12. Preferably, the adhesive 61 is applied in a continuous path extending along the entire outside margin of the container 12 adjacent the open top. After applying the adhesive 61, a flexible sheet of thermoplastic, paper, or aluminum wrap 62 is placed over the open top of the container 12, and is pressed against the adhesive 61 to seal the container 12 and preserve the food for subsequent use. The covered container 12 may be placed in the refrigerator or freezer at temperatures less than 50 degrees Fahrenheit and 32 degrees Fahrenheit, respectively, or in an oven at temperatures in excess of 100 degrees Fahrenheit. Preferably, the high and low temperatures do not adversely affect the performance of the adhesive 61. The adhesive 61 is water-soluble for easy cleaning, and is readherable so that the container 12 can be uncovered and later recovered using the same wrap 62 and without additional application of adhesive 61 to the container 12.

A method for preserving a perishable food product is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A method for preserving a perishable product contained in a sealed package adapted for being opened by a consumer to access the product and subsequently re-closed by the consumer for further storage of unused product remaining in the package, said method comprising the steps of:

(a) the consumer forming an opening in the sealed package;

(b) using a handheld applicator, applying a releasable contact adhesive to a first area of the package adjacent to opening formed in the package by the consumer; and (c) pressing a second area of the package against the adhesive to temporarily re-close the opening, thereby preserving the unused product inside the package.

2. A method for preserving a perishable product according to claim 1, and further comprising the steps of reopening the package at the opening to access the unused product, and subsequently readhering the first and second areas of the package to re-close the opening without further application of the adhesive to the package.

3. A method for preserving a perishable product according to claim 1, wherein the step of applying the adhesive comprises applying the adhesive in a continuous path extending along an entire length of the opening.

4. A method for preserving a perishable product according to claim 1, wherein the handheld applicator comprises an elongated stick container.

5. A method for preserving a perishable product according to claim 1, and comprising placing the unused product contained in the re-closed package in a refrigerator at a temperature less than 50 degrees Fahrenheit.

6. A method for preserving a perishable product according to claim 1, and comprising placing the unused product contained in the re-closed package in a freezer at a temperature less than 32 degrees Fahrenheit.

7. A method for preserving a perishable product according to claim 1, and comprising placing the unused product contained in the re-closed package in an oven at a temperature greater than 100 degrees Fahrenheit.

8. A method for preserving a perishable product contained in a sealed package adapted for being opened by a consumer to access the product and subsequently re-closed by the consumer for further storage of unused product remaining in the package, said method comprising the steps of:

(a) the consumer forming an opening in the sealed package;

(b) using a handheld applicator, applying a releasable, food-grade, contact adhesive to a first area of the package adjacent to the opening formed in the package by the consumer; and (c) pressing a second area of the package against the adhesive to temporarily re-close the opening, thereby preserving the unused product inside the package.

* * * * *